US005632127A

United States Patent [19]

Agar et al.

[11] Patent Number: 5,632,127

[45] Date of Patent: May 27, 1997

[54] WALL FRAME SYSTEM

[76] Inventors: Robert S. Agar; Norman J. Hachey; Clive W. R. Careford, all c/o Partition Components Incorporated, 150-14 Ferrier St., Markham, Ontario, Canada, L3R 3K3

[21] Appl. No.: 538,773

[22] Filed: Oct. 5, 1995

Related U.S. Application Data

[63] Continuation of Ser. No. 319,877, Oct. 7, 1994, abandoned.

[51] Int. Cl.[6] ..... B65B 7/06

[52] U.S. Cl. ..... 52/481.2; 52/489.2; 52/238.1

[58] Field of Search ..... 52/481.1, 481.2, 52/476, 483.1, 489.1, 489.2, 763, 765, 770, 238.1, 241, 511; 211/191, 192; 248/222.2, 221.2

[56] References Cited

U.S. PATENT DOCUMENTS

| | | | |
|---|---|---|---|
| 1,915,697 | 6/1933 | Robinson . | |
| 2,055,442 | 9/1936 | Jones | 72/118 |
| 2,642,968 | 6/1953 | Roush et al. | 189/86 |
| 2,881,924 | 4/1959 | Kruse et al. | 211/26 |
| 3,461,638 | 8/1969 | Balinski | 52/732 |
| 3,482,369 | 12/1969 | Burke | 52/669 |
| 3,671,061 | 6/1972 | Dawdy | 287/20.92 W |
| 3,906,695 | 9/1975 | Pilgrim et al. | 52/489.2 |
| 4,056,904 | 11/1977 | Dawdy | 52/127 |
| 4,128,979 | 12/1978 | Price . | |
| 4,129,279 | 12/1978 | Burkholder | 211/192 X |
| 4,194,333 | 3/1980 | Paton et al. | 52/235 |
| 4,342,397 | 8/1982 | Halstrick | 211/191 |
| 4,394,808 | 7/1983 | Thorsell | 52/483 |
| 4,425,049 | 1/1984 | Travis | 211/191 X |
| 4,448,004 | 5/1984 | Thorsell | 52/241 |
| 4,693,047 | 9/1987 | Menchetti | 52/664 |
| 4,704,835 | 11/1987 | Jordan | 52/486 |
| 4,719,730 | 1/1988 | Winkowski | 52/238.1 |
| 4,811,539 | 3/1989 | Menchetti | 52/489.21 |
| 4,837,988 | 6/1989 | Menchetti et al. | 52/36 |
| 5,216,859 | 6/1993 | Moreno et al. | 52/238.1 |
| 5,224,322 | 7/1993 | van den Toorn | 52/765 |
| 5,330,066 | 7/1994 | Carroll | 211/191 X |
| 5,408,796 | 4/1995 | Hashimoto et al. | 52/409.2 |
| 5,426,904 | 6/1995 | Gilmore | 52/481.1 X |

FOREIGN PATENT DOCUMENTS

| | | | |
|---|---|---|---|
| 252398 | 7/1964 | Australia | 52/481.1 |
| 1314682 | 3/1993 | Canada | E04B 5/52 |
| 1120632 | 7/1968 | United Kingdom | E04B 3/20 |
| WO8902502 | 3/1989 | WIPO | E04B 1/60 |
| WO9107555 | 5/1991 | WIPO | E04B 2/74 |
| 10404 | 5/1994 | WIPO | 52/483.1 |

OTHER PUBLICATIONS

The cover sheet and two additional sheets from a brochure by Partition Systems Inc. entitled "PS–350 Movable Wall System".

*Primary Examiner*—Creighton Smith
*Attorney, Agent, or Firm*—Mark R. Wisner

[57] ABSTRACT

A wall frame has C-shaped vertical studs each with a leg having sets of openings therein. Each set of openings comprises a pair of side-by-side openings above a further opening. A wall panel support has a central mounting portion with a pair of side-by-side hooks above a projecting tongue; a wing extends from either side of the central mounting portion. In order to attach the panel support to one of the sets of openings, the hooks of the central mounting portion are received within the side-by-side openings of a set of openings and the tongue is snap fit into the remaining opening. A wall panel having gang nail clips may then be placed against the stud and lowered so that the clips rest on the top edges of the wings of the panel support.

22 Claims, 3 Drawing Sheets

WALL FRAME SYSTEM

This application is a continuation of application Ser. No. 08/319,877, filed Oct. 7, 1994 now abandoned.

BACKGROUND OF THE INVENTION

1. Field of the Invention

This invention relates to apparatus for use in a wall frame and to a wall frame.

2. Description of the Related Art

U.S. Pat. No. 4,128,979 issued Dec. 12, 1978 to Price describes a wall frame comprised of vertical studs and horizontal channel members. The vertical studs have a series of horizontally aligned openings and a horizontal channel member extends through each set of aligned openings. The frame may demountably mount a gypsum board wall panel with a plurality of clips attached thereto. More particularly, a number of gang nail plates, each with a clip in the nature of a finger downwardly depending therefrom, may be hammered into a gypsum board panel. The panel may then be supported by the channel members of the wall framing system by setting the clips of the board onto the horizontal channel members. A difficulty with this wall frame is that the horizontal channel members extending along the wall cavity make it difficult to provide vertical electrical conduit within the cavity.

U.S. Pat. No. 4,811,539 issued Mar. 14, 1989 to Menchetti provides a wall frame for gypsum board panels which can accommodate vertical conduit. In Menchetti, special U-shaped studs have two parallel web portions with aligned openings. Each pair of aligned openings tightly receives a short horizontal channel member. Thereafter, a gypsum board panel with clips of the type described hereinbefore may be clipped into the horizontal short channel members. Blocks of wood may be provided at the free ends of the short channel members to prevent the gypsum board rattling against the short channel members. Alternatively, the short channel members may be provided with metal tags which press against the board panel.

Field assembly of Menchetti's frame may prove time consuming as the short channel members must be inserted into the firmly holding openings in his U-shaped stud.

This invention seeks to overcome drawbacks of the known prior art.

SUMMARY OF THE INVENTION

According to the present invention, there is provided apparatus for use in a wall frame comprising: a longitudinally elongated upstanding stud having a plurality of longitudinally spaced sets of mountable means, each said set comprising a transverse upwardly directed lip and a transverse downwardly directed ledge; a plurality of wall panel supports, each having a panel supporting wing extending from either side of a central mounting portion, said mounting portion comprising a hook and a spaced tongue, said hook for hooking over said upwardly directed lip of a set of mountable means of said stud and said tongue thereafter receivable under said ledge of said set of mountable means such that, thereafter, said tongue inhibits upward displacement of said support by abutment with said ledge and, therefore, inhibits unhooking of said hook of said wall panel support from said upwardly directed tongue.

DESCRIPTION OF THE DRAWINGS

In the figures which disclose example embodiments of the invention.

DESCRIPTION OF THE PREFERRED EMBODIMENTS

Figure 1:
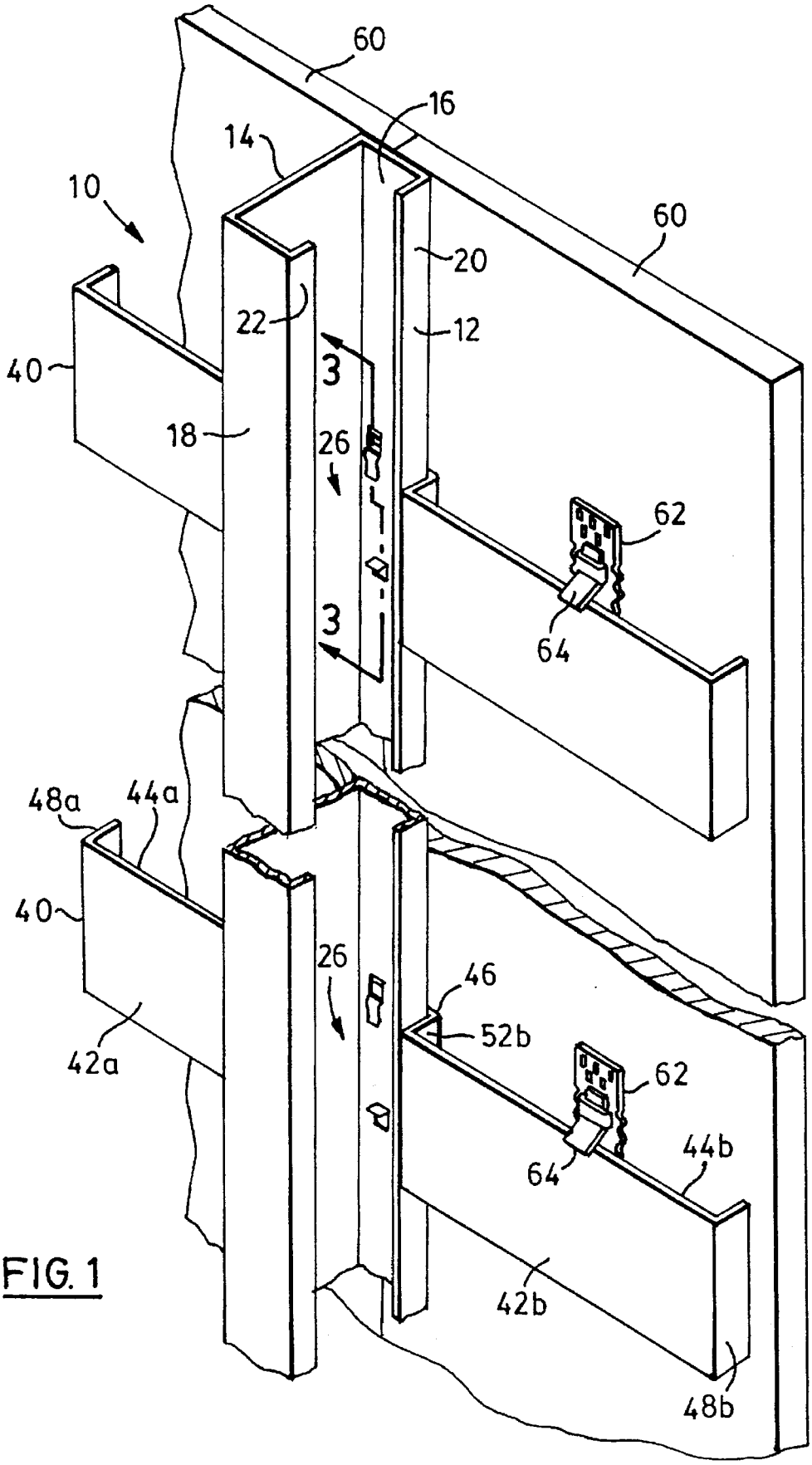
FIG. 1 is a perspective view of a portion of a wall frame made in accordance with this invention.
Figure 3:
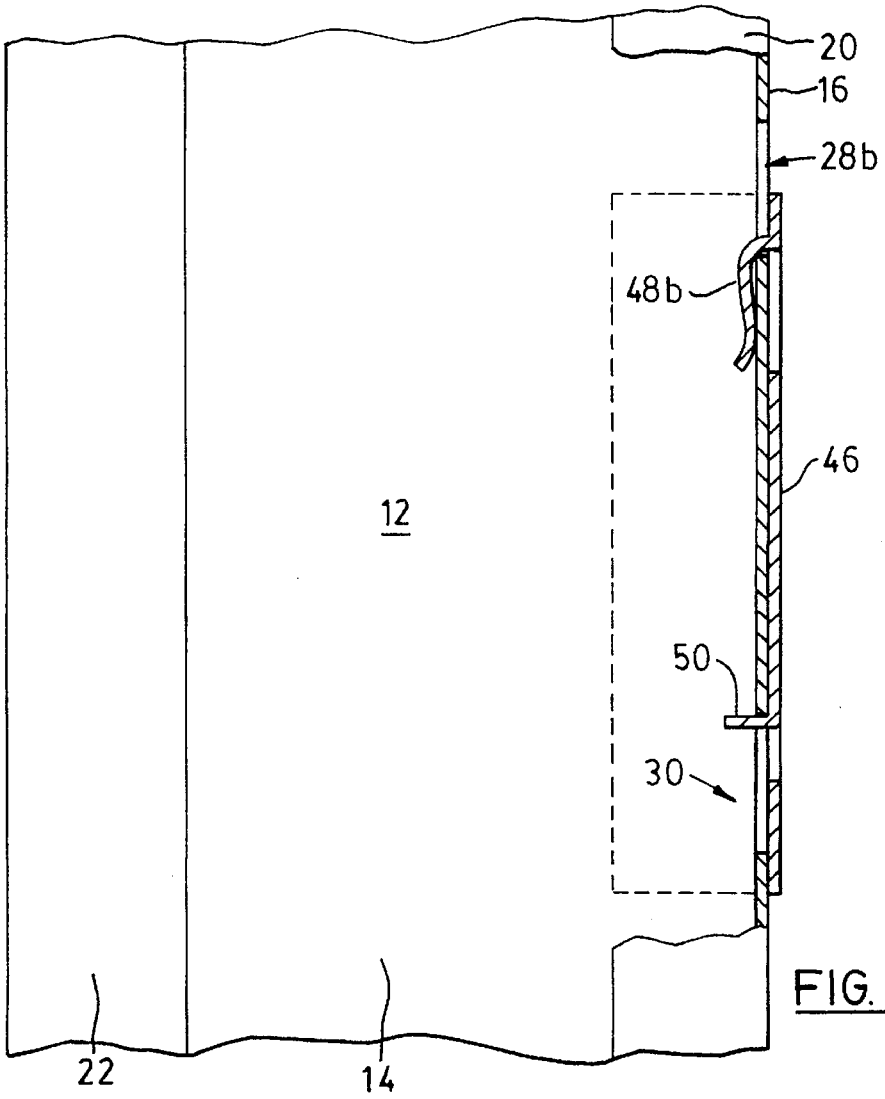
FIG. 3 is a cross-sectional view along the lines 3—3 of FIG. 1.

With reference to FIGS. 1 and 3, a wall frame 10 comprises a vertically extending C-shaped stud 12 with a medial web 14 and two parallel legs 16 and 18 depending therefrom. The legs 16 and 18 terminate in inwardly directed flanges 20 and 22, respectively. The stud has a plurality of longitudinally spaced sets 26 of mountable means.

Figure 2:
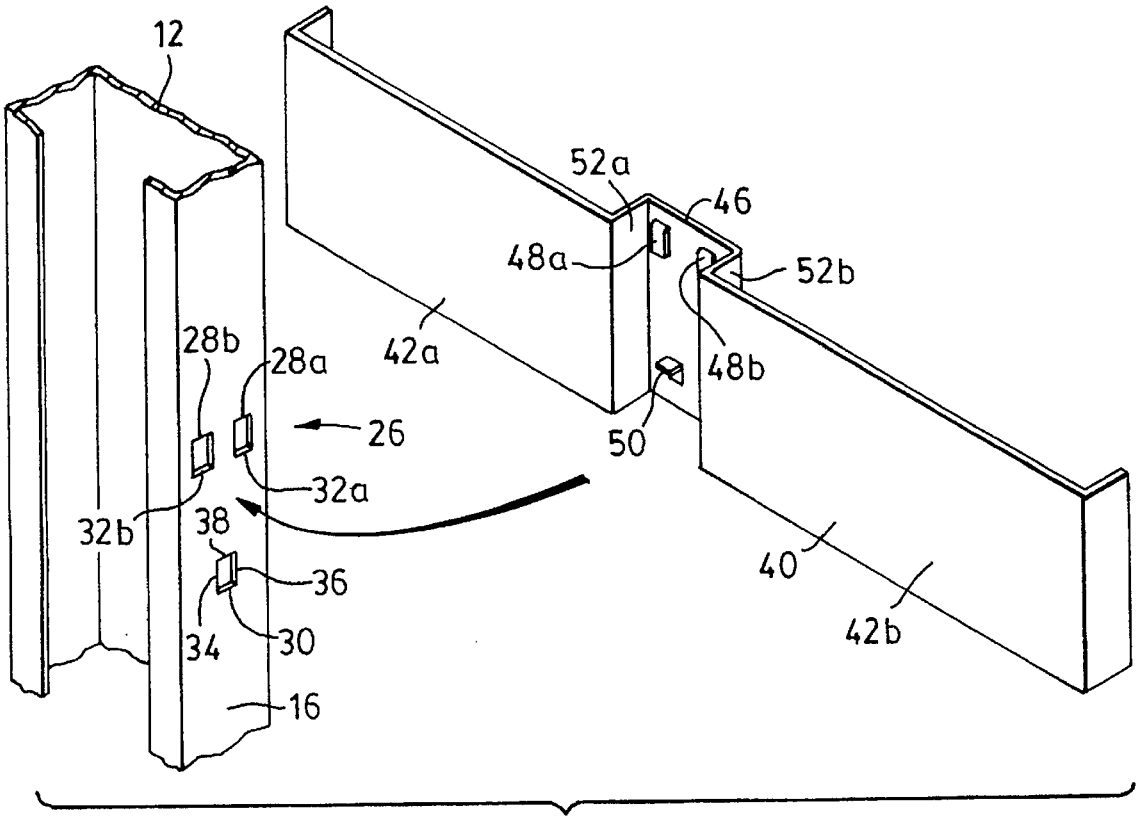
FIG. 2 is an exploded perspective view of a portion of the system of FIG. 1.

As best seen in FIG. 2, each set 26 comprises a first pair of side-by-side openings 28*a*, 28*b* in leg 16 as well as a longitudinally spaced opening 30 in the leg. The lower edge 32*a*, 32*b* of each opening 28*a*, 28*b*, respectively, may be considered to be an upwardly directed transverse lip, foe reasons which will become apparent hereafter. Additionally, it should be noted that the upper edge 38 of opening 30 may be considered as a downwardly directed ledge and edges 34, 36 of this opening are vertically extending walls.

Referencing FIGS. 1 and 2, a plurality of wall panel supports 40 are attached to stud 12. Each wall panel support 40 has a wall panel supporting wing 42*a*, 42*b* extending from one of side walls 52*a*, 52*b*, respectively, of a central mounting portion 46. Each wing has a top edge 44*a*, 44*b* and a terminal wing tip 48*a*, 48*b* which extends out of the plane of the wing.

As best seen in FIGS. 2 and 3, mounting portion 46 has a pair of side-by-side hooks 48*a*, 48*b*, as well as a tongue 50 which is spaced from the hooks.

To assemble the wall frame system of this invention, a number of studs 12 are vertically erected along an area to be walled. Typically such studs 12 are erected at four foot intervals. Each stud is erected such that for any set 26 of mountable means on the stud, openings 28*a*, 28*b* are positioned above opening 30, as seen in FIG. 2. Further, each stud is erected such that leg 16 of the stud faces the side which is to bear the wall panels. Although not shown, a standard C-shaped stud (without mountable means) may be vertically erected between each pair of studs 12. A wall panel support 40 is then attached to each set 26 of mountable means of the studs 12 as follows. The side walls 52*a*, 52*b* of the panel support 40 slide over flange 20 and web 14 of a stud 12 and hooks 48*a*, 48*b* of the support 40 are received within openings 28*a*, 28*b*, respectively, of a set of mountable means 26 of the stud. The panel support is then lowered until the hooks rest on upwardly directed transverse lips 32*a*, 32*b* of these openings 28*a*, 28*b*. In this position, tongue 50 is registered with the opening 30 of stud 12. The panel support may then be tilted so that the tongue projects through opening 30, as seen in FIG. 3. In this regard, preferably the tongue 50 is positioned so that it snap fits to transverse ledge 38 of opening 30.

As shown in FIG. 1, once the panel supports have been attached to the studs 12 thereby forming wall frame 10, wall panels 60 having gang nail clips 62 may be supported by the wall frame. More particularly, typically a wall panel which spans the distance between two studs 12 is placed in abutting relation with frame 10 and then lowered until clips 64 of the gang nail clips 62 attached to the panel rest on the top edge 44*a* or 44*b* of a wing 42*a* or 42*b* of panel supports 40. Because clips 64 are angled downwardly and outwardly, the panel 60 will, by its own weight, be urged into tight abutment with the wall frame 10 as the clips 64 slip over the top edge 44*a*, 44*b* of the wings 42*a*, 42*b*. Wing tips 48*a*, 48*b* of the panel support 40 abut wall panel 60 and apply pressure to the wall panel in order to inhibit rattling between the wall panel and the wall frame 10. The optional studs between studs 12 provide additional solidity to the wall.

It will be apparent that the weight of the panels themselves is what provides the force to ensure the panels are tightly locked to the wall frame 10.

Wall panels 60 are heavy and it frequently happens that a panel will be bumped into one or more of the wall panel supports 40 while workers attempt to position the panel properly for lowering onto the panel supports. Tongue 50 of the panel support inhibits upward deflection of the support when the support is bumped thereby significantly reducing the likelihood that the support will be knocked off the stud when bumped. Knocking a support off the stud causes considerable assembly delays since the wall panel 60 must then be moved out of the way, the support re-installed, and the panel moved back into position again for another attempt at hanging it on the supports. Therefore, the panel supports of the subject invention, in avoiding most such delays, increase construction efficiency.

If a gang nail clip 62 is only supported on one of wings 48*a*, 48*b* of any particular wall panel support 40, this will impart a torque on the panel support. This torque is resisted by virtue of tongue 50 abutting one of walls 34, 36 of opening 30 in the stud 12 and by one of side walls 52*a*, 52*b* abutting flange 20 or web 14 of the stud.

Figure 4:
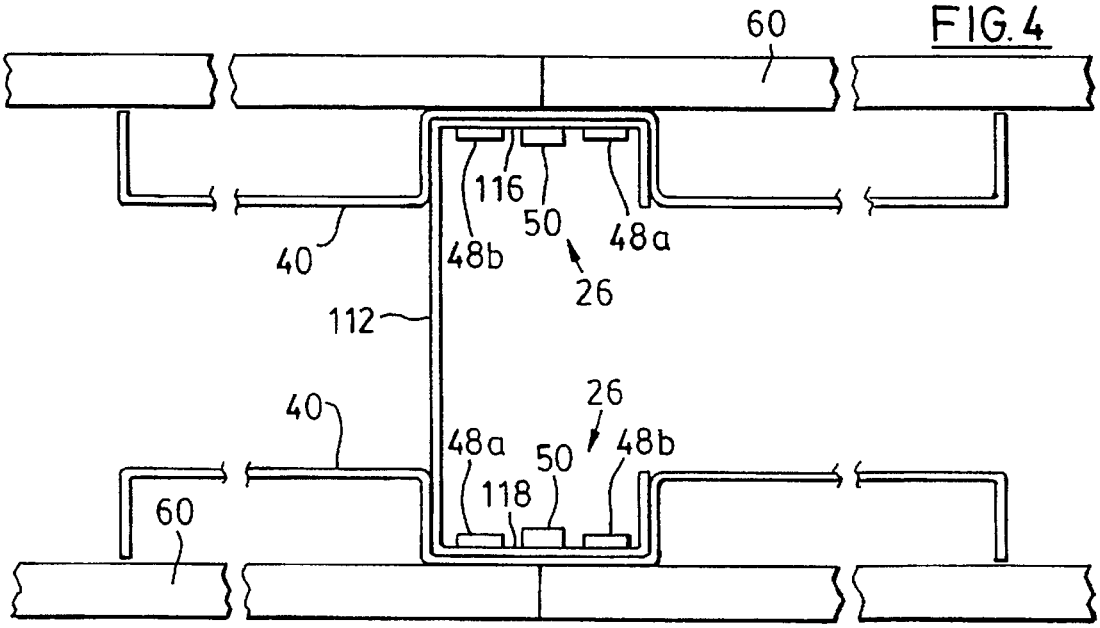
FIG. 4 is a plan view of a wall frame system made in accordance with a further embodiment of this invention.

FIG. 4 illustrates an alternative embodiment of the invention wherein like parts have been given like reference numerals. Turning to FIG. 4, stud 112 has sets of mountable means 26 in both legs 116 and 118. With this embodiment, wall panels 60 may be supported on both legs of stud 112 so as to form a finished wall on both sides of the stud.

Openings punched into stud 12 provide an economical manner of forming the upwardly directed lips 32*a*, 32*b* and downwardly directed ledges 38. However, these features could be incorporated on stud 12 in other fashions, such as by welding lips and ledges to the stud.

Other modifications will be apparent to those skilled in the art and, therefore, the invention is defined in the claims.

What is claimed is:

1. Apparatus for use in a wall frame comprising:

a longitudinally elongated upstanding stud having a plurality of longitudinally spaced sets of mountable means, each said set comprising a transverse upwardly directed lip and a transverse downwardly directed ledge;

a plurality of wall panel supports, each having a panel supporting wing extending from either side of a central mounting portion, said mounting portion comprising a hook and a spaced tongue, said hook for hooking over said upwardly directed lip of a set of mountable means of said stud and said tongue thereafter receivable under said ledge of said set of mountable means such that, thereafter, said tongue inhibits upward displacement of said support by abutment with said ledge and, therefore, inhibits unhooking of said hook of said wall panel support from said upwardly directed tongue.

2. The apparatus of claim 1 wherein said tongue of a wall panel support is positioned for snap fitting to one said ledge after said a hook of said wall panel support has hooked over one said upwardly directed lip.

3. The apparatus of claim 2 wherein each said set of mountable means of said stud comprises a second upwardly directed lip and wherein each of said plurality of wall panel supports comprises a second hook positioned so that said hook and said second hook are for hooking to said upwardly directed lip and said second upwardly directed lip of one set of mountable means.

4. The apparatus of claim 3 wherein, for any given set of mounting means, said upwardly directed lip and said second upwardly directed lip are positioned above said downwardly directed ledge.

5. The apparatus of claim 4 wherein each said set of mounting means comprises a pair of longitudinally extending walls extending to said ledge, said tongue of a wall panel support for reception between said longitudinally extending walls such that said tongue may abut one or other of said longitudinally extending walls to inhibit rotation of said wall panel support.

6. The apparatus of claim 5 wherein said mounting portion of said wall panel support has a pair of parallel walls for surrounding a portion of said stud such that one of said walls may abut said stud to inhibit rotation of said wall panel support.

7. The apparatus of claim 6 wherein said stud comprises a C-shaped channel having a medial web with two parallel legs extending therefrom, one of said legs having a plurality of openings therein such that each said transverse upwardly directed lip comprises a lower edge of one of said openings and such that each said downwardly directed ledge with a pair of longitudinally extending walls define upper and side edges, respectively, of one of said openings.

8. The apparatus of claim 7 wherein each said wing has a terminal wing tip extending out of the plane of said wing such that when one of said plurality of wall panel supports is hooked to said stud, each said wing tip is directed away from said stud.

9. A wall frame comprising:

a vertically elongated stud having a plurality of vertically spaced sets of mountable means, each said set comprising a transverse upwardly directed lip and a transverse downwardly directed ledge;

a plurality of wall panel supports, each having a panel supporting wing extending from either side of a central mounting portion, said mounting portion comprising a hook and a spaced tongue, said hook hooked over said lip of a set of mountable means of said stud and said tongue received under said ledge of said set of mountable means such that said tongue inhibits upward displacement of said support by abutment with said ledge and, therefore, inhibits unhooking of said hook of said wall panel support from said upwardly directed tongue.

10. The wall frame of claim 9 wherein said upwardly directed lip is positioned above said downwardly directed ledge.

11. The wall frame of claim 10 wherein said stud comprises a C-shaped channel having a medial web with two parallel legs extending therefrom, one of said legs having a plurality of openings therein such that each said transverse upwardly directed lip comprises a lower edge of one of said openings and such that each said downwardly directed ledge defines an upper edge of one of said openings.

12. A frame for supporting the panels of a demountable wall, each of the panels having gang nail clips attached thereto, the gang nail clips having a clip angled downwardly and outwardly for mounting the panels to the frame, said frame comprising:

a vertical stud having a pair of side-by-side openings and a longitudinally spaced opening, and a wall panel support mounted to said stud, said wall panel support having side-by-side hooks, each of said hooks being received in one of said pair of side-by-side openings, a tongue positioned in said longitudinally spaced opening, and a wall supporting wing to which a clip of said gang nail clips is mounted for supporting the panel to which said gang nail clip is attached.

13. The frame of claim 12 wherein each of the side-by-side openings formed in said stud includes a lower edge forming an upwardly directed transverse lip on which each of the hooks of said wall panel support rests when received within the opening.

14. The frame of claim 12 wherein the longitudinally spaced opening formed in said stud includes an upper edge forming a downwardly directed ledge, the tongue of said wall panel support being snap fit thereto to inhibit upward deflection of said wall panel support.

15. The frame of claim 13 wherein the longitudinally spaced opening formed in said stud includes edges forming vertically extending walls against which the tongue of said wall panel support abuts to resist torque on said wall panel support.

16. A frame for supporting panels of a demountable wall, each of the panels having gang nail clips attached thereto, the gang nail clips having a clip angled downwardly and outwardly for mounting the panels to the frame, comprising a vertical stud including parallel legs with side-by-side openings and a longitudinally spaced opening formed therein and a wall panel support mounted to said stud, said wall panel support comprising side-by-side hooks, each of the hooks being received in one of the side-by-side openings formed in the parallel legs of said stud, a tongue positioned in the longitudinally spaced opening formed in the parallel legs of said stud, and a wall panel supporting wing to which the clips of said gang nail clips are mounted for supporting the panels to which said gang nail clips are attached.

17. The frame of claim 16 wherein each of the side-by-side openings formed in the parallel legs of said stud includes a lower edge forming an upwardly directed transverse lip on which each of the hooks of said wall panel support rests when the hook is received within the opening.

18. The frame of claim 17 wherein the longitudinally spaced opening formed in the parallel legs of said stud includes an upper edge forming a downwardly directed ledge, the tongue of said wall panel support being snap fit thereto to inhibit upward deflection of said wall panel support.

19. The frame of claim 17 wherein the longitudinally spaced opening formed in the parallel legs of said stud includes edges forming vertically extending walls against which the tongue of said wall panel support abuts to resist torque on said wall panel support.

20. The frame of claim 16 further comprising side walls formed in said wall panel support for abutting said stud.

21. The frame of claim 16 wherein said wall panel support additionally comprises wing tips.

22. A frame for supporting a wall panel having a gang nail clip attached thereto, the gang nail clip having a clip angled downwardly and outwardly for mounting the panel to the frame, comprising:

a stud having side-by-side and longitudinally spaced openings formed therein, and a wall panel support mounted to said stud, said wail panel support comprising side-by-side hooks received in said side-by-side openings, a tongue for positioning in said longitudinally spaced opening, and a panel supporting wing to which the clip of said gang nail clip is mounted for supporting the panel to which said gang nail clip is attached.

* * * * *